US006647884B1

(12) United States Patent
La Vos et al.

(10) Patent No.: US 6,647,884 B1
(45) Date of Patent: Nov. 18, 2003

(54) METHOD AND APPARATUS FOR TRANSVERSELY REGISTERING A SHEET FOR TRANSFER OF AN IMAGE THERETO

(75) Inventors: Peter George La Vos, Baarlo (NL); Lodewijk Tarcisius Holtman, Venlo (NL)

(73) Assignee: Océ-Technologies B.V., Venlo (NL)

( * ) Notice: Subject to any disclaimer, the term of this patent is extended or adjusted under 35 U.S.C. 154(b) by 28 days.

(21) Appl. No.: 09/716,435

(22) Filed: Nov. 21, 2000

(30) Foreign Application Priority Data

Nov. 25, 1999 (NL) ..... 1013670

(51) Int. Cl.[7] ..... B65H 7/00; B41F 1/28

(52) U.S. Cl. ..... 101/485; 101/232; 101/481; 271/228

(58) Field of Search ..... 101/232, 279, 101/481, 484, 485, 486; 400/578, 582; 271/228

(56) References Cited

U.S. PATENT DOCUMENTS 4,855,607 A 8/1989 Eckl ..... 271/227
5,219,159 A 6/1993 Malachowski et al. ..... 271/228
5,273,274 A 12/1993 Thomson et al. ..... 271/228
5,697,609 A * 12/1997 Williams et al. ..... 271/228
5,794,176 A 8/1998 Milillo ..... 271/228
6,273,418 B1 * 8/2001 Fujikura et al. ..... 271/227

FOREIGN PATENT DOCUMENTS

EP 0814040 A1 12/1997
WO 9818053 4/1998

OTHER PUBLICATIONS

Patent Abstracts of Japan, vol. 1998, No. 11, Sep. 20, 1998 & JP10 167527 A (Fuji Xerox Co Ltd), Jun. 23, 1998 *Abstract* & US 6 019 365 A (Matsumura) Feb. 1, 2000.

* cited by examiner

*Primary Examiner*—Leslie J. Evanisko
(74) *Attorney, Agent, or Firm*—Birch, Stewart, Kolasch & Birch, LLP

(57) ABSTRACT

A method and apparatus for registering a sheet for transfer of an image thereto. Disposed in the feed path of a sheet is a transport nip for feeding a sheet and for transversely registering the sheet and image by displacing the transport nip transversely of the feed direction. On each registration step the transport nip shifts in said transverse direction to a middle position. Transverse positioning means bring either the sheet before reaching the transport nip or the image on an image support into a transverse position such that a registration step by the transport nip to a middle position can take place and hence no reset movement of the transport nip is required between successive registration steps.

4 Claims, 6 Drawing Sheets

METHOD AND APPARATUS FOR TRANSVERSELY REGISTERING A SHEET FOR TRANSFER OF AN IMAGE THERETO

BACKGROUND OF THE INVENTION

The present invention relates to a method of registering a sheet fed in a feed path through a transport nip, with an image to be transferred thereto, at an image transfer location and from an image support to said sheet. The transport nip, in a registration step, is displaceable transversely of the feed direction between two end positions in order to register a sheet retained in the transport nip with said image.

A method of this kind is known from U.S. Pat. No. 5,219,159. In the method described therein the transport nip is returned, after each registration step, to a middle position situated between the end positions. During this displacement the transport nip cannot receive a following or subsequent sheet, so that the distance between sheets for successive registration must be relatively considerable.

The object of the present invention is to provide a method wherein the distance between the sheets which are to be successively brought into register with an image to be received thereon can be considerably reduced.

According to the present invention, with registration steps taking place successively the transverse displacement of the transport nip is directed initially to a middle position situated between the two end positions, and the sheet and/or image for registration is brought, for the purpose of that registration step, into a transverse position required by a registration step in said initial direction.

Consequently, a sheet can be rapidly and accurately brought into register with an image to be received thereon, in a direction transverse to the feed direction, by means of the transport nip displaceable in the transverse direction, without the transport nip being inoperative for any time between two registration steps in order to reset the transport nip between the transport of two sheets to be successively brought into registration.

The registration can take place without any interruption whatsoever by bringing the sheet into a transverse position required by the registration step in said initial direction, with continuous feed of the sheet to the image transfer location.

If, as an alternative, images to be successively brought into registration with supplied sheets are applied to the image support in the transverse direction at mutually offset positions, then the effect achieved is that at the image transfer location sheet edges do not always need to come into contact with the same part of the image support, and this prevents edge outlining on the image support.

BRIEF DESCRIPTION OF THE DRAWINGS

The present invention will be explained in detail hereinafter with reference to the accompanying drawings wherein.

DETAILED DESCRIPTION OF THE INVENTION

Figure 1:
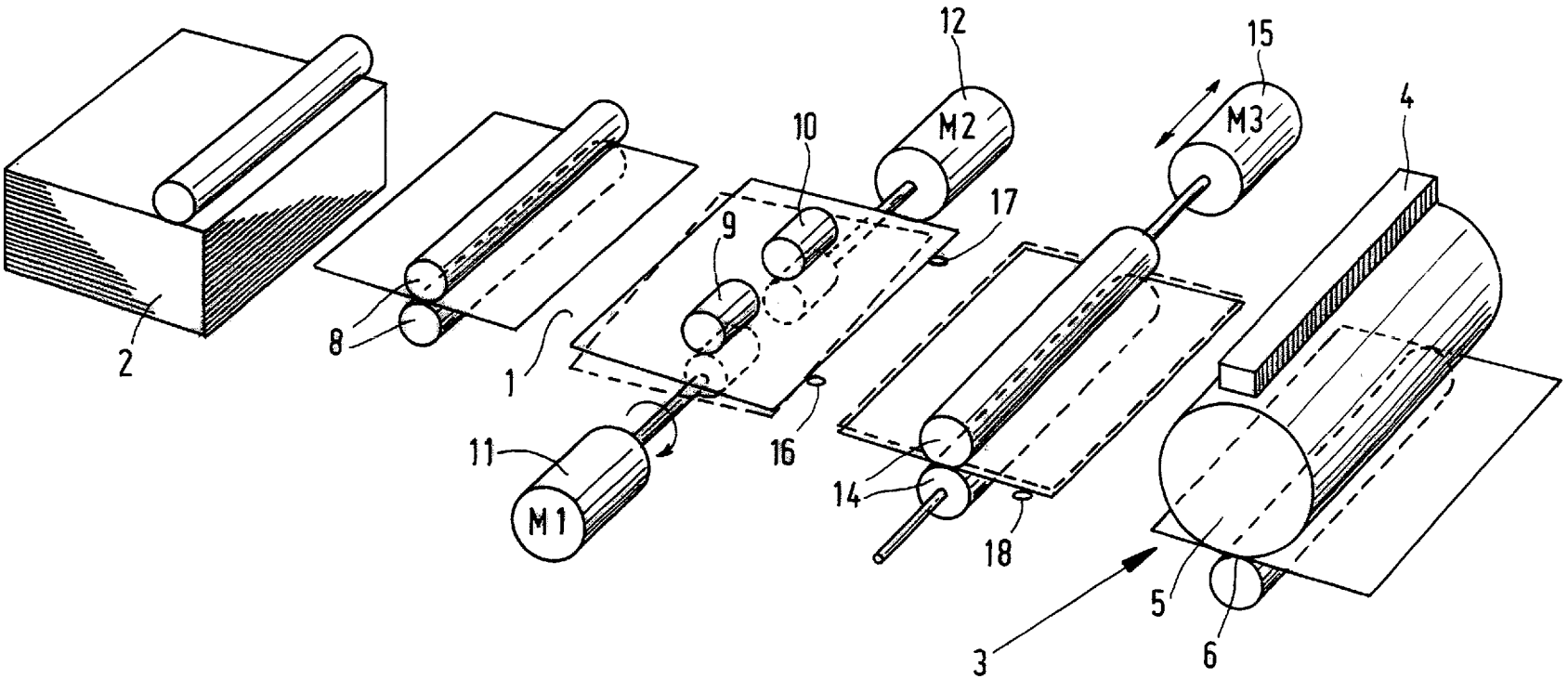
FIG. 1 is a perspective view of a first embodiment of a printing apparatus in which the invention can be applied.

The printing apparatus shown in FIG. 1 comprises a sheet transport path 1, along which sheets are fed, one-by-one, from a stack 2 to an image transfer station 3. An image formed on a rotatable drum 5 by image forming means 4 is transferred to a supplied sheet in the image transfer station 3 at an image transfer location 6.

A number of transport nips are disposed in the sheet transport path 1 at distances somewhat shorter than the shortest sheet length. A first transport nip formed by roller pair 8 feeds a sheet taken from a stack 2 to roller pairs 9 and 10, which are disposed next to one another and which are drivable separately at different speeds by motors 11 and 12 respectively, for the purpose of aligning a skewed sheet with the sheet transport continuing in the forward direction, and for the purpose of displacing a supplied sheet over a specific distance, in a transverse direction to the direction of feed, as will be explained in greater detail hereinafter with reference to FIGS. 2 and 3. Downstream of roller pairs 9 and 10 there is disposed a transport roller pair 14 which is displaceable in the axial direction by motor 15 in order to bring into transverse register with an image formed on the drum 5, a sheet which, although aligned by roller pairs 9 and 10, is still somewhat transversely shifted, for example, as a result of the skewing movement required for aligning.

In FIG. 1, the measuring means required for registration, for the purpose of measuring the skew position of a supplied sheet, are represented by sensors 16 and 17 and the measuring means required for measuring the transverse position of an aligned sheet are represented by sensor 18.

Sensor 18 may consist of a single sensor disposed along a line on which the side edge of a sheet lies when said sheet is in its nominal position, in which position it comes exactly into register with an image to be transferred thereto. In the case of the supply of sheets of different formats, this single sensor is displaceable in the transverse direction to a side line suitable for that format. To avoid such an adjustment of the sensor 18 and in order to measure the extent of the deviation to be corrected by transport roller pair 14, sensor 18 can also be in the form of an array of sensors extending transversely of the sheet feed direction over the area in which the sheet side edges of different formats may lie. Depending on the sheet format, the required axial displacement of the transport roller pair 14 is determined from the difference between the original position of the sheet edge requiring correction, and the required position of the sheet edge on the sensor array, thereby bringing the sheet and image into registration.

Upon reaching the transport roller pair 14 displaceable in the transverse direction, a sheet may easily shift ±8 mm with respect to its nominal position. This deviation may be due to a somewhat shifted insertion of a stack of sheets 2, due to the skew occurring in the sheet transport path 1 as a result of varying tolerances of transport means in the sheet feed path, and/or due to the transverse displacement produced by the roller pairs 9 and 10 to correct the skew.

A sheet which has been shifted transversely to, for example, a maximum of ±8 mm can be brought, by transport roller pair 14, by translation in the transverse direction, into a position in which the sheet is exactly in register with an image which is to be received at the image transfer location 6. By limiting this maximum sheet displacement for correction by transport roller pair 14, a translation of a sheet in the transverse direction can also be partially achieved by transport roller pairs 9 and 10. This can be done by driving one of the transport roller pairs 9 or 10 at a speed different from the speed of the other roller pair during a specific period, so that a sheet engaged by these transport roller pairs 9 and 10 can be skewed in one direction over a specific angle. By reversing the speed ratio between the transport roller pairs 9 and 10 for a specific period, the first skewing movement obtained can be eliminated, but a transverse displacement of the sheet still remains.

One example of a transverse sheet displacement of this kind is explained in European Patent Application 0 814 040 and in the prior art described therein. It is preferable to bring a sheet into the required transverse position as close as possible in front of the image transfer location, by means of a sheet transport nip displaceable in the axial direction, because this entails a minimum risk of a remaining skew position, as may readily be the case in the event of a sheet shift produced by sheet skewing movements in a transverse direction to the sheet feed direction.

Figure 2:
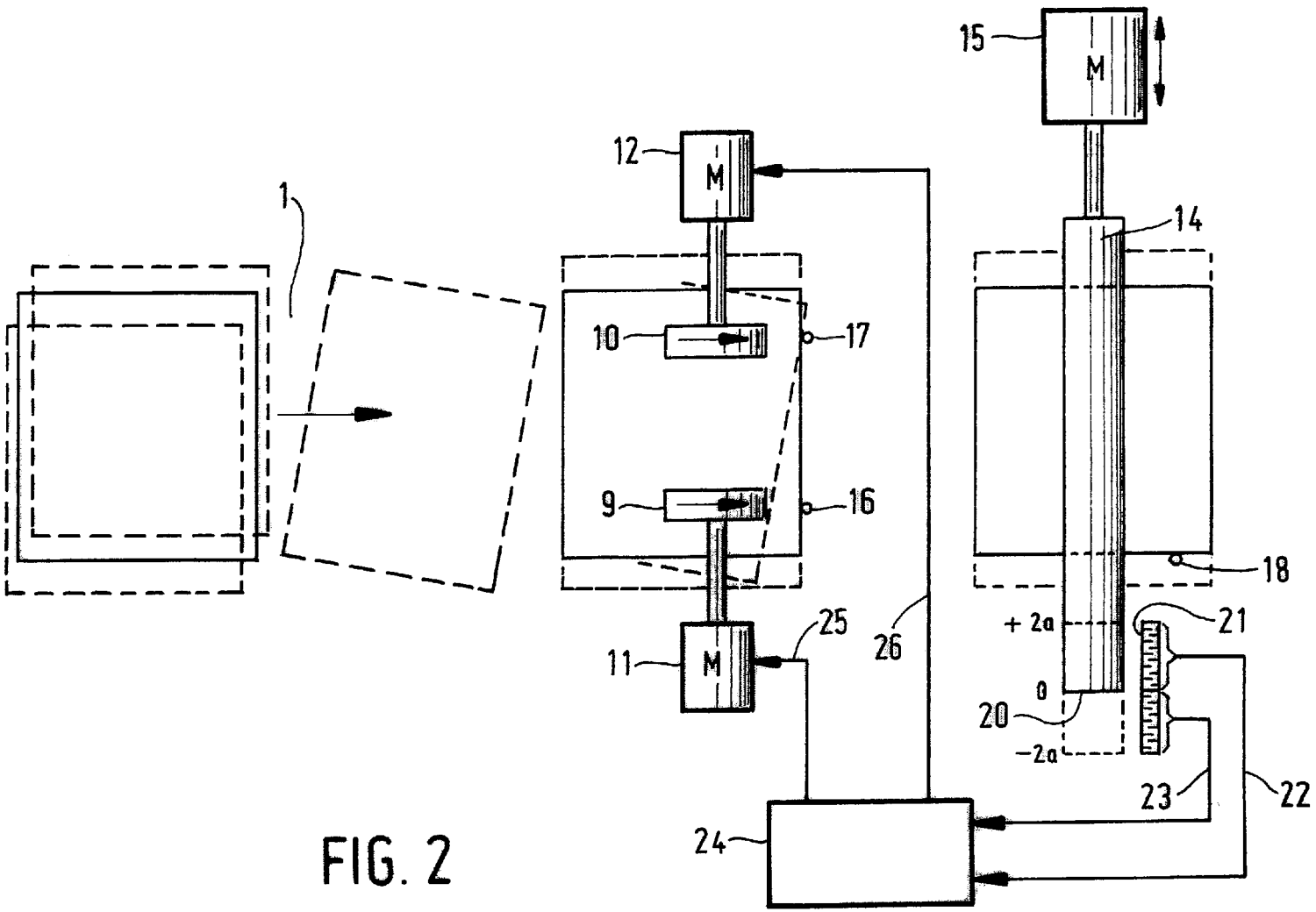
FIG. 2 shows a control system for the printing apparatus illustrated in FIG. 1.

FIG. 2 is a top plan view of the sheet transport path 1 of the printing apparatus shown in FIG. 1.

The free end 20 of one of the axially displaceable transport rollers 14 is displaceable from a central position denoted by 0 to end positions shown in broken lines and having the references +2a and −2a, respectively. Disposed next to the free end 20 is a sensor 21 which delivers a signal 22 to control device 24 when the sensor 21 detects the end 20 in the area situated between 0 and +2a, and the sensor 21 also delivers a signal 23 to control device 24 when the sensor 21 detects the end 20 in the area between 0 and −2a.

When sensor 21 passes from delivering a signal 22 to delivering a signal 23, which, referring to FIG. 2, means a movement of roller pair 14 and a sheet clamped therebetween in the downward direction, control device 24 delivers signals 25 and 26 to motors 11 and 12, respectively, so that upon the receipt of a following sheet, said sheet, as considered in FIG. 2, experiences a predetermined downward displacement.

Figure 3:
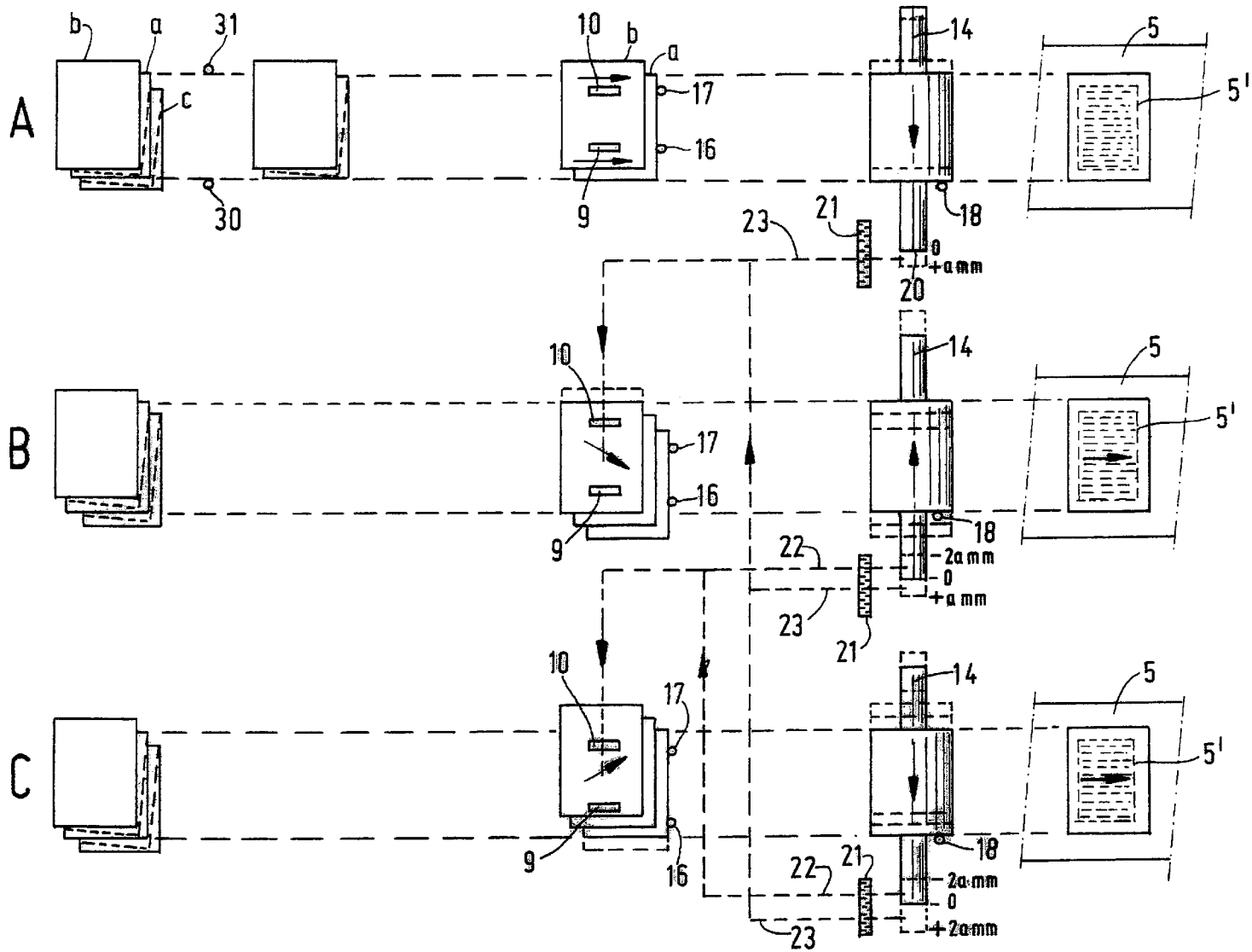
FIG. 3 diagrammatically shows successive states that can be occupied by the printing apparatus shown in FIGS. 1 and 2.

Sensor 21 may be formed by an array of sensors as shown in FIG. 3, or, alternatively, by a single sensor combined with an axial displacement of transport roller pair 14 by means of a stepping motor. It is always possible to derive the exact position of the transport roller pair 14 to the left or right of its central position from the number of counted steps performed by the motor from the single sensor at a starting position.

FIG. 3 shows a number of stages A, B and C of the aligning of a supplied sheet. In stage A, a number of sheet positions a, b and c are shown on the left, to denote the position a sheet may occupy when fed to sheet transport rollers 9 and 10. The continuous lines in the case of "a" illustrate a sheet supplied in a nominal transverse position which requires no transverse correction to come into register with an image 5' formed on image support 5. The references "b" and "c" show the supplied sheet in transverse positions in which it has a maximum deviation from the nominal transverse position, such deviation requiring correction. Between the positions "a", "b", and "a", "c", the broken lines denote skew positions of a supplied sheet. The positions "b" and "c" represent extreme positions which can be occupied by a sheet aligned by a deskewing movement.

Sensors 30 and 31 can detect on which side of the nominal position "a" a supplied sheet is located.

In FIG. 3 the case is worked out in which the first sheet supplied is situated between positions "a" and "b", even after a possible skew correction.

It will be clear that the case in respect of a sheet situated between positions "a" and "c" when fed between transport rollers 9 and 10 is comparable thereto. The only difference is that all the actions take place in the reverse directions.

As will be seen at A in FIG. 3, there is only an aligning of a skew-fed sheet between transport rollers 9 and 10. Aligning is effected by driving rollers 9 and 10 at different speeds depending on the time elapsing between detection of the front edge of the sheet by sensors 16 and 17. A criterion in this connection is that the aligned sheet should be between positions "a" and "b" after said aligning has taken place. A sheet which is then situated between rollers 9 and 10 in position "a" experiences no further action by rollers 9 and 10 and the same applies to roller pair 14, because the sheet edge is at sensor 18.

A sheet which, after aligning by rollers 9 and 10, is finally in position "b", and also comes between roller pair 14 in that position, is free of sensor 18. In response thereto, roller pair 14 moves in the direction of the arrow until the sheet edge reaches sensor 18. The roller pair 14 moves the sheet which has now been brought into transverse register to the image 5' on the image support 5.

On displacement of roller pair 14 in the said axial direction, end surface 20 comes into the range of the bottom half of sensor 21, in response to which, via signal 23, rollers 9 and 10 move a following sheet downwards over a distance of a mm, seen in the plane of FIG. 3, apart from any aligning action of the rollers 9 and 10.

The resulting spread of the position of a following sheet between roller pairs 9 and 10 is shown in B. Depending on the actual position of the sheet, there is subsequently a correcting displacement by roller pair 14, which may vary between 0 and 2a mm. This results in a position of the end surface 20 between +a mm and −2a mm, depending on the position before correction of the second sheet and the magnitude of correction for the second sheet.

With a resulting position between 0 and −2a mm, sensor 21 delivers a signal 22 which moves the transport rollers 9 and 10 upwards for a following sheet, as shown under C, in the direction indicated by the arrow over a distance of a mm seen in the plane of FIG. 3, again apart from any aligning action by rollers 9 and 10.

With a resulting position between 0 and +a mm, sensor 21 delivers a signal 23 which moves transport rollers 9 and 10 downwards for a following sheet, as shown under B, in the direction indicated by the arrow over a distance of a mm, seen in the plane of FIG. 3, again apart from any aligning action by rollers 9 and 10.

The resulting spread of the position of a following third sheet between roller pairs 9 and 10 is shown in C.

Depending on the actual position of the sheet, there is thereafter again a correction shift by roller pair 14, which can vary between 0 and 2a mm. This results in the position of end surface 20 between +2a mm and −2a mm, depending on the position before correction of the third sheet and the magnitude of the correction of the third sheet.

Following sheets are moved "downwards" (in accordance with B) or "upwards" (in accordance with C) by rollers 9 and 10 over a distance of a mm depending on the detected position of end surface 20 at one side of its middle position or at the other side of its middle position.

In this way, roller pair 14 does not have to perform an idle stroke between transverse registration of successive sheets, so that the sheets can be fed in register in rapid sequence to image transfer station 3.

If, in the case of each following sheet supplied, sensors 30 and 31 determine, in situations B and C as well, whether a sheet is situated in the area between "a" and "b" or between "a" and "c", the required transverse displacement by roller pairs 9 and 10 can be limited in comparison with the sheet position shown in FIG. 3. In situation B in fact, only a sheet supplied between "a" and "b" has to be shifted downwards by a distance of a mm in order to ensure that each sheet is fed below its nominal position. In situation C, the same applies to a sheet fed between "a" and "c". Thus the maximum required correction stroke of roller pair 14 can be restricted to half, from +a mm to −a mm.

It has already been indicated on page 3 of the present application that by means of roller pairs 9 and 10 it is possible to ensure that a sheet undergoes a translation in the transverse direction in order to limit the maximum shift for correction by transport roller pair 14 and thus maintain short the distance between the transport roller pair 14 and the sheet transfer station following the same. This is advantageous for good registration between the sheet and image without a new deviation occurring.

A limitation of the correction movement by transport roller pair 14 for correcting a transverse sheet shift can also be achieved by taking into account, in the transverse sheet displacement by roller pairs 9 and 10, the exact transverse position of a sheet supplied to roller pairs 9 and 10. The exact transverse position of the sheet can be measured by constructing sensors 30 and 31 in the form of a sensor array which extends transversely of the feed direction and thus can measure the position of the side edges of a supplied sheet.

In the case of the situations B and C shown in FIG. 3, where the supply of a sheet after transport roller pair 14 has been moved out of its middle position for the correction of a first sheet, roller pairs 9 and 10 are adjusted to shift a supplied sheet over the distance corresponding to the measured deviation of a sheet from its required nominal transverse positions, which deviation can, for example, be as much as ±5 mm. Moreover, roller pairs 9 and 10 displace a sheet over a short fixed distance which corresponds to the maximum remaining deviation to be corrected by roller pair 14, for example, a distance of 2 mm, in the opposite direction to the direction in which roller pair 14 was displaced in a preceding register step. In situations B and C, the distances over which roller pairs 9 and 10 displace a sheet in the transverse direction, in the case of original deviations of for example +5, +3, 0, −3, and −5 mm (where + denotes a deviation in the direction of b and − denotes a deviation in the direction of c) are as follows:

| Original deviation | Transverse displacement of roller pairs 9 and 10 in situation B | Transverse displacement of roller pairs 9 and 10 in situation C |
|---|---|---|
| +5 mm | 5 + 2 = +7 mm ↓ | 5 − 2 = +3 mm ↓ |
| +3 mm | 3 + 2 = +5 mm ↓ | 3 − 2 = +1 mm ↓ |
| 0 mm | 0 + 2 = +2 mm ↓ | 0 − 2 = −2 mm ↑ |
| −3 mm | −3 + 2 = −1 mm ↑ | −3 − 2 = −5 mm ↑ |
| −5 mm | −5 + 2 = −3 mm ↑ | −5 − 2 = −7 mm ↑ |

The embodiment in which the required correction stroke of roller pair 14 is relatively small is of importance, particularly for use in a printing apparatus in which there is a relatively considerable distance between roller pairs 9 and 10 in which a rough registration takes place and roller pair 14 in which a fine registration takes place. This distance may be such that a number of sheets are situated therebetween. In that case what is involved is a follow-up effect, in which the maximum required correction stroke of roller pair 14 is a product of the correction stroke per sheet and the number of sheets which may be situated at a maximum between roller pairs 9 and 10 and roller pair 14.

Figure 4:
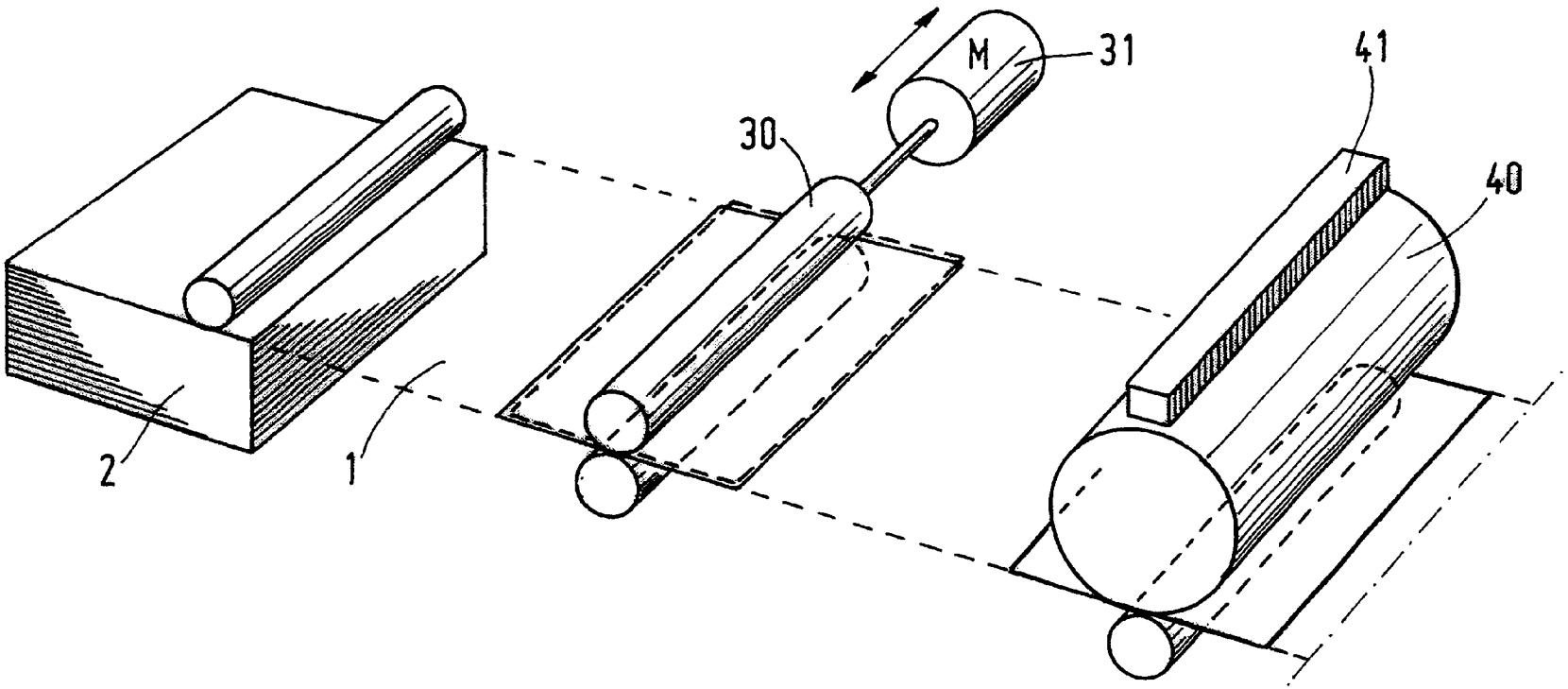
FIG. 4 is a perspective view of a second embodiment of a printing apparatus in which the invention can be applied.

As in the case of the printing apparatus shown in FIG. 1, the printing apparatus shown in FIG. 4 comprises a sheet transport path 1 along which sheets are fed from a stack 2 one by one to an image transfer station where an image formed on a rotatable drum 40 by image forming means 41 is transferred to the supplied sheet.

Disposed in the sheet transport path 1 is a transport roller pair 30 which is displaceable in the axial direction by a motor 31 to bring the sheet supplied from stack 2 into transverse register with an image formed on the drum 40.

On reaching the transport roller pair 30, which is displaceable in the transverse direction, a sheet may again easily be disposed with a ±4 mm shift with respect to its nominal position.

A sheet shifted to a maximum of ±4 mm in the transverse direction can be brought by transport roller pair 30 by translation in the axial direction, into a position in which the sheet is exactly in register with an image for transfer from drum 40.

Figure 5:
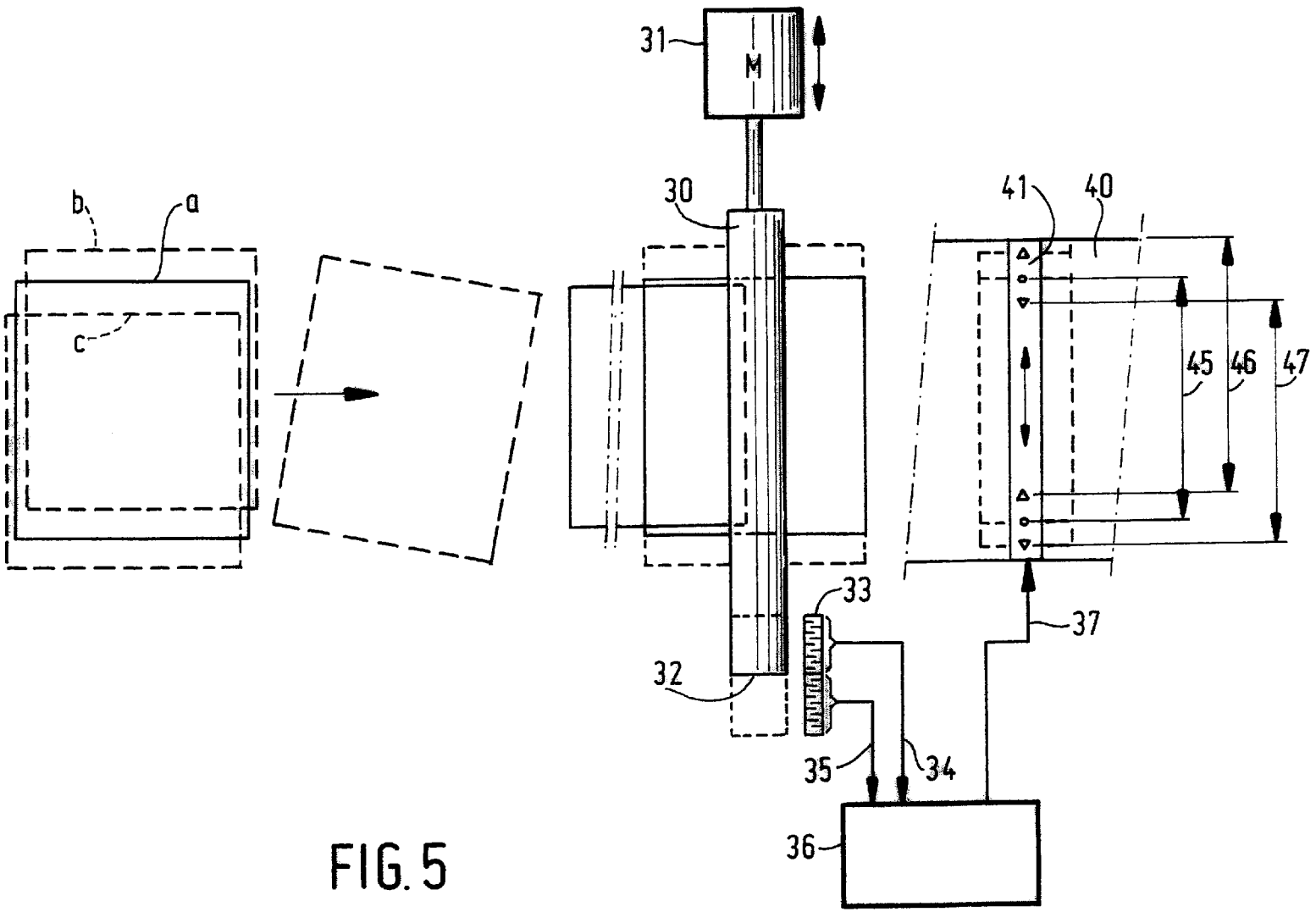
FIG. 5 shows a control system for the printing apparatus shown in FIG. 4.

FIG. 5 is a top plan view of the sheet transport path 1 of the printing apparatus of FIG. 4, showing a control system 36 suitable for that purpose.

A sheet supplied in a skew position from stack 2 is first pressed against a stationary or reversing roller pair 30 in order to press the front edge straight against the nip formed by roller pair 30, as shown in FIG. 5. The aligned sheet is then fed into the nip of roller pair 30, whereafter said roller pair is displaceable in the axial direction in order to bring a sheet, at a maximum, into two end positions shown in broken lines, with roller pair 30, said end positions corresponding to extreme sheet positions "b" and "c". The free end 32 of the roller pair shown in FIG. 5 (or any other fixed point on roller pair 30) is displaceable into end positions shown in broken lines.

Disposed next to the free end 32 is a sensor 33 which delivers a signal 34 to the control device 36 when the sensor 33 detects the end 32 in the top half (FIG. 5) of its displacement range. Also, the sensor 33 delivers a signal 35 to the control device 36 when the sensor 33 detects the end 32 in the bottom half of its displacement range. Initially, image-forming means 41 forms an image in the central area 45.

When sensor 33 passes from delivering a signal 34 to delivering a signal 35, which, as seen in the plane of FIG. 5, entails a downward movement of roller pair 30 with a sheet held therebetween, then control device 36 delivers a signal 37 to the image forming means 41 to ensure that the image is printed in an area 46 on a following printing cycle. On passing from delivering signal 35 to delivering signal 34, control device 36 delivers a signal 37 to ensure that the image is printed in an area 47 in a following printing cycle.

FIG. 6 again shows a number of stages A, B and C of bringing a sheet into transverse register with an image to be printed thereon. In stage A, a number of sheet positions "a", "b" and "c" are shown on the left with intermediate skew positions which can be occupied by a sheet fed to the transport roller pair 30, these positions corresponding to the sheet positions explained in connection with FIG. 3.

Figure 6:
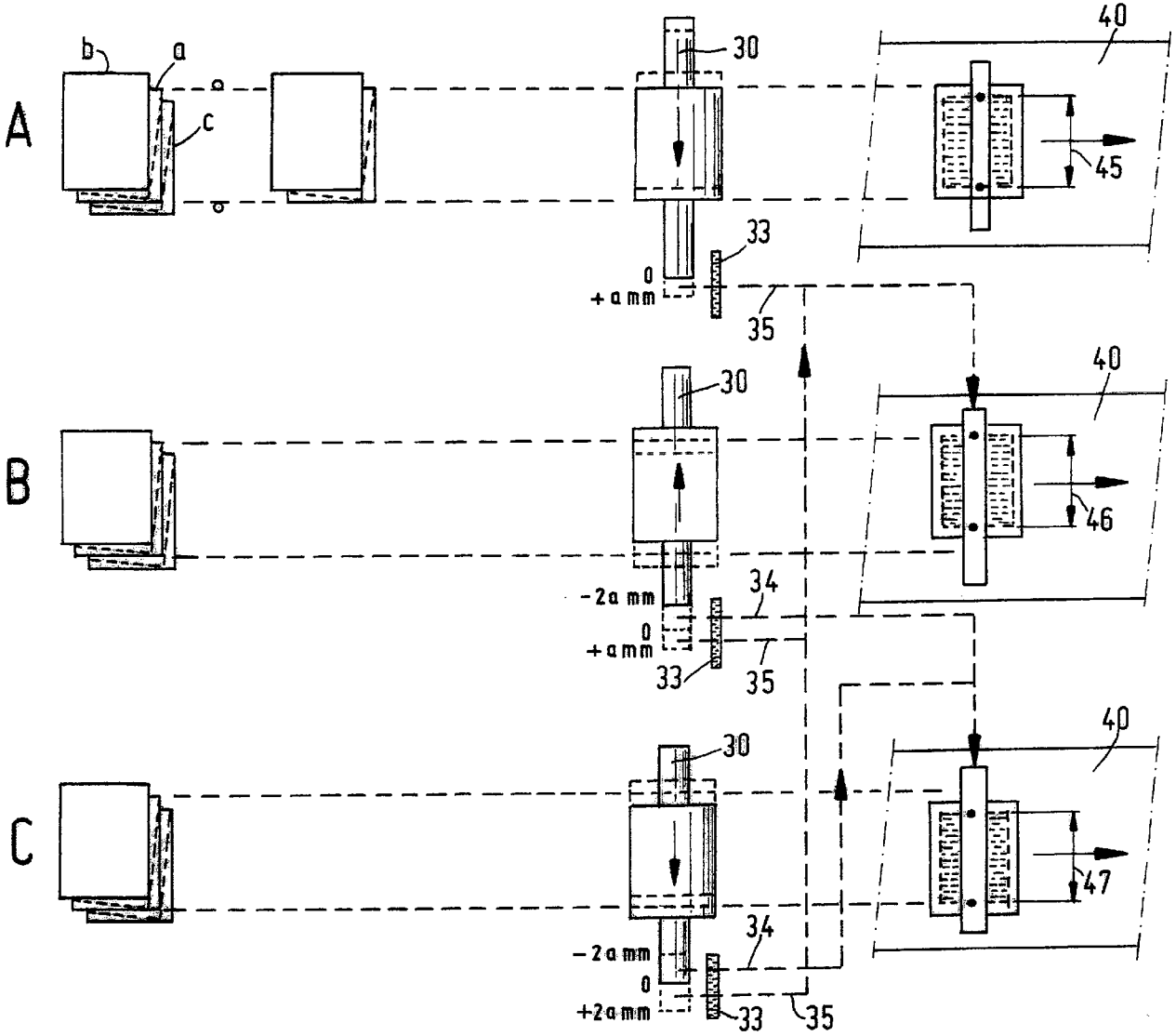
FIG. 6 diagrammatically illustrates successive states that can be occupied by the printing apparatus shown in FIGS. 4 and 5.

A sensor shown at A at the nominal sheet edge positions can detect on which side of the nominal position "a" a supplied sheet is located. In FIG. 6 at A, the case is worked out in which the first supplied sheet is situated between positions "a" and "b" i.e. after any skew correction.

A sheet in the nominal feed position "a" requires no register action and holds the roller pair 30 in its middle position shown in solid lines at A and results in image formation in the central area 45.

At A sheet which after skew correction is finally in position "b" against roller pair 30 results in a movement of a sheet clamped between roller pair 30, from the position shown in broken lines to the position shown in solid lines, whereafter the roller pair 30 brings the sheet into register with an image applied in area 45. On displacement of roller pair 30 in the said axial direction, end surface 32 comes in the bottom half of the range of sensor 33, in response to which a signal 35 is delivered with causes a following image to be imaged in the area 46. The resulting spread of the position of a following sheet between roller pair 30 is shown under B and results in a correcting shift by roller pair 30 varying between 0 and 2a mm. This results in the position of end surface 32 between +a mm and −2a mm, depending on the position before correction of the second sheet and the magnitude of the correction for that sheet.

On a resulting position at B between 0 and −2a mm, sensor 33 delivers a signal 34 which causes a following, third, image to be imaged in the area 47 as shown under C in FIG. 6. On a resulting position at B between 0 and +a mm, sensor 33 delivers a signal 35 which causes a following image to be imaged in the area 46.

The resulting spread of the position of the following, third sheet between roller pair 30 before correction is shown under C. Depending on the actual position of the sheet, there is again a correcting displacement by roller pair 30 which can vary between 0 and 2a mm, resulting in a position of end surface 32 between +2a mm and −2a mm, depending on the position before correction of the third sheet and the magnitude of correction of the third sheet.

Following images are imaged by the image forming means 41 in an area 46 (as shown at B) or area 47 (as shown at C) depending on the detected position of end surface 32 on one side of its middle position or on the other side of its middle position.

Thus the roller pair 30, shown in the apparatus illustrated in FIGS. 4 to 6, does not need to make an idle stroke between registering sheets, so that here again sheets can come into register in rapid sequence with images to be applied thereto. One advantage of the apparatus shown in FIGS. 4 to 6 over the apparatus shown in FIGS. 1 to 3, is that transport roller pairs are required to be able to shift a sheet transversely before reaching the transport roller pair displaceable in the axial direction. It must be borne in mind that the distance covered by an image between the image forming means 41 and the image transfer location is less than the distance covered by a sheet from the transverse positioning means 30 to the image transfer location.

In the above-described embodiments of the present invention, the axially displaceable transport roller pair 14 and 30, respectively, consists of a single transport roller pair. It can, however, also be formed by a double transport roller pair, such as roller pairs 9 and 10, although the roller pairs drivable independently of one another for aligning a sheet are displaceable jointly in the axial direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for registering a sheet for desired orientation within a sheet path which comprises supplying sheets in succession to a transport nip disposed in the sheet path, said transport nip defined by a pair of opposing transport rollers, transferring an image from an image support to a sheet being conveyed along the sheet path, displacing the pair of opposing transport rollers in a transverse direction between two end positions relative to the sheet path, detecting the displacement of the transport rollers through a middle position situated between said two end positions, selectively positioning, with transverse positioning means, a sheet in one of two opposite transverse positions before said sheet reaches the pair of transport rollers and reversing the direction of movement of the transverse positioning means on the introduction of the subsequent sheets in response to the detection of the displacement of the transport rollers through the middle position.

2. An apparatus for registering a sheet for desired orientation within a sheet path which comprises a pair of opposing transport rollers forming a transport nip and disposed within the sheet path for the supply of sheets, an advanceable image support containing an image thereon, an image transfer location for transferring the image from the image support to a sheet being conveyed along the sheet path, and a displacement mechanism for displacing the pair of opposing transport rollers in a transverse direction relative to the sheet path between two end positions, wherein detection means are provided for detecting the displacement of the transport rollers through a middle position situated between said end positions, transverse positioning means are provided for selectively positioning a sheet in one of two opposite transverse positions before said sheet reaches the pair of transport rollers and control means are provided which, in response to the detection of the displacement of the transport rollers through the middle position reverses the direction of movement of the transverse positioning means on the introduction of subsequent sheets.

3. A method for registering sheets to bring them into transverse alignment with images corresponding to these sheets, which comprises:

supplying a sheet to a transport nip disposed in a sheet path;

displacing the transport nip in a transverse direction when the sheet is within the said nip;

transferring an image corresponding to the said sheet from an image support to the sheet;

detecting a resulting displaced position of the transport nip;

calculating a distance using at least the said displaced position as input;

displacing a subsequent sheet over the said distance in the transverse direction before the subsequent sheet reaches the displaced transport nip, such that a next sheet after the subsequent sheet can be brought into registration with a corresponding image on the image support by displacing the said transport nip when the subsequent sheet is in said transport nip, starting from the said displaced position.

4. The method according to claim 3, wherein the displacing of a subsequent sheet before said subsequent sheet reaches the transport nip takes place when the said sheet is being transported in the sheet path.

* * * * *